US008179042B2

(12) United States Patent
Yanagita et al.

(10) Patent No.: US 8,179,042 B2
(45) Date of Patent: May 15, 2012

(54) PLASMA DISPLAY PANEL, PLASMA DISPLAY PANEL UNIT, AND METHOD OF MANUFACTURING PLASMA DISPLAY PANEL

(75) Inventors: Hideaki Yanagita, Miyazaki (JP); Takashi Sasaki, Hiratsuka (JP)

(73) Assignee: Hitachi Plasma Display Limited, Miyazaki (JP)

( * ) Notice: Subject to any disclaimer, the term of this patent is extended or adjusted under 35 U.S.C. 154(b) by 0 days.

(21) Appl. No.: 12/863,749

(22) PCT Filed: Sep. 4, 2008

(86) PCT No.: PCT/JP2008/002445

§ 371 (c)(1),
(2), (4) Date: Nov. 15, 2010

(87) PCT Pub. No.: WO2010/026617

PCT Pub. Date: Mar. 11, 2010

(65) Prior Publication Data

US 2011/0050077 A1 Mar. 3, 2011

(51) Int. Cl.
*H01J 17/49* (2006.01)

(52) U.S. Cl. ..... 313/583; 313/585

(58) Field of Classification Search ..... 313/582–587
See application file for complete search history.

(56) References Cited

U.S. PATENT DOCUMENTS

| | | | | |
|---|---|---|---|---|
| 7,492,080 | B2 * | 2/2009 | Kang et al. | 313/36 |
| 7,521,867 | B2 * | 4/2009 | Sasaki et al. | 313/586 |
| 2005/0062422 | A1 | 3/2005 | Sasaki et al. | |
| 2006/0158074 | A1 * | 7/2006 | Kang et al. | 313/36 |
| 2008/0165315 | A1 * | 7/2008 | Nishida et al. | 349/137 |
| 2009/0184621 | A1 | 7/2009 | Kang et al. | |

FOREIGN PATENT DOCUMENTS

| | | |
|---|---|---|
| EP | 0 223 651 | 5/1987 |
| JP | 62-98534 | 5/1987 |
| JP | 8-124486 | 5/1996 |
| JP | 10-198287 | 7/1998 |
| JP | 2001-266755 | 9/2001 |
| JP | 2005-116508 | 4/2005 |
| JP | 2006-201745 | 8/2006 |

OTHER PUBLICATIONS

International Preliminary Report on Patentability and Written Opinion of the International Searching Authority, with English translation thereof, issued in International Patent Application No. PCT/JP2008/002445, mailed Apr. 21,2011.

* cited by examiner

*Primary Examiner* — Peter Macchiarolo
(74) *Attorney, Agent, or Firm* — McDermott Will & Emery LLP

(57) ABSTRACT

A plasma display panel has a first plate and a second plate facing each other via a discharge space. A plurality of first electrodes and a plurality of second electrodes extending in a first direction, and a plurality of address electrodes extending in a second direction intersecting with the first direction are provided at the first plate. Also, a plurality of first barrier ribs extending in the second direction are integrally formed with the second plate at the first plate side of the second plate. Further, the plasma display panel has, for example, an anti-reflective film formed on a surface of the second plate at an opposite side of a surface facing the first plate. As a result, a contrast of an image can be improved.

12 Claims, 8 Drawing Sheets

PLASMA DISPLAY PANEL, PLASMA DISPLAY PANEL UNIT, AND METHOD OF MANUFACTURING PLASMA DISPLAY PANEL

RELATED APPLICATIONS

This application is the U.S. National Phase under 35 U.S.C. §371 of International Application No. PCT/JP2008/002445, filed on Sep. 4, 2008, the entire contents of which application is incorporated by reference herein by reference.

TECHNICAL FIELD

The present invention relates to a plasma display panel, a plasma display panel unit, and a manufacturing method of a plasma display panel.

BACKGROUND ART

A plasma display panel (PDP) is made up by adhering two pieces of glass plates (a front glass plate and a back glass plate) with each other, and displays an image by generating discharge light in a space (discharge space) formed between the glass plates. Cells corresponding to pixels in the image are in a self-luminescence type, and phosphors emitting visible lights in red, green, and blue by receiving ultraviolet ray generated by the discharge are coated thereon.

For example, a PDP in a three-electrode structure having X, Y electrodes and address electrodes displays images by generating a sustain discharge between the X electrodes and the Y electrodes. The cells generating the sustain discharge (cells to be lighted) are selected by, for example, selectively generating an address discharge between the Y electrodes and the address electrodes.

In a general PDP, the X and Y electrodes are disposed on a front glass plate while having intervals with each other, and the address electrodes disposed between barrier ribs extending in an orthogonal direction of the X electrodes and between the barrier ribs adjacent each other are disposed at the back glass plate. A general barrier rib is formed to be transparent relative to the visible light. Accordingly, for example, in a plasma display device (PDP device) made up by using this kind of PDP, there is a possibility in which outside light incident on the PDP penetrates the barrier rib, reflects in the PDP device, and this reflected light is incident on the PDP again. In this case, the light penetrating the barrier rib and reflected in the PDP device is emitted from the PDP together with the visible light emitted from the phosphors, and a contrast when the image is displayed on the PDP is lowered. A PDP in which the barrier ribs are made a dark color is proposed to improve the contrast (for example, refer to Patent Document 1).

In recent year, a PDP in which the three electrodes of the X electrodes, Y electrodes, and address electrodes are disposed at the front glass plate is proposed (for example, refer to Patent Document 2). In this kind of PDP, the address electrodes provided at the front glass plate are disposed along the barrier ribs formed at the back glass plate.

Patent Document 1: Japanese Unexamined Patent Application Publication No. 2001-266755

Patent Document 2: Japanese Unexamined Patent Application Publication No. 2005-116508

DISCLOSURE

Problems to be Solved

In Patent Document 2, the barrier ribs are integrally formed with the back glass plate. In the PDP in which the barrier ribs are integrally formed with the back glass plate, a material choice of the back glass plate is limited and there is a possibility in which a cheap material cannot be used when the barrier ribs are made the dark color. When the cheap material cannot be used for the back glass plate, a manufacturing cost of the PDP increases. Note that an invention to improve the contrast of the image is not proposed in the PDP having the three electrodes at the front glass plate.

A proposition of the present invention is to improve the contrast of the image in the PDP having the three electrodes at the front glass plate.

Means for Solving the Problems

A plasma display panel has a first plate and a second plate facing each other via a discharge space. A plurality of first electrodes and a plurality of second electrodes extending in a first direction, and a plurality of address electrodes extending in a second direction intersecting with the first direction are provided at the first plate. Also, a plurality of first barrier ribs extending in the second direction are integrally formed with the second plate at the first plate side of the second plate. Further, the plasma display panel has, for example, an antireflective film formed on a surface of the second plate at an opposite side of a surface facing the first plate.

Effects

According to the present invention, it is possible to improve a contrast of an image in a PDP having three electrodes at a front glass plate.

DETAILED DESCRIPTION OF THE EMBODIMENTS

Hereinafter, embodiments of the present invention are described by using the drawings.

Figure 1:
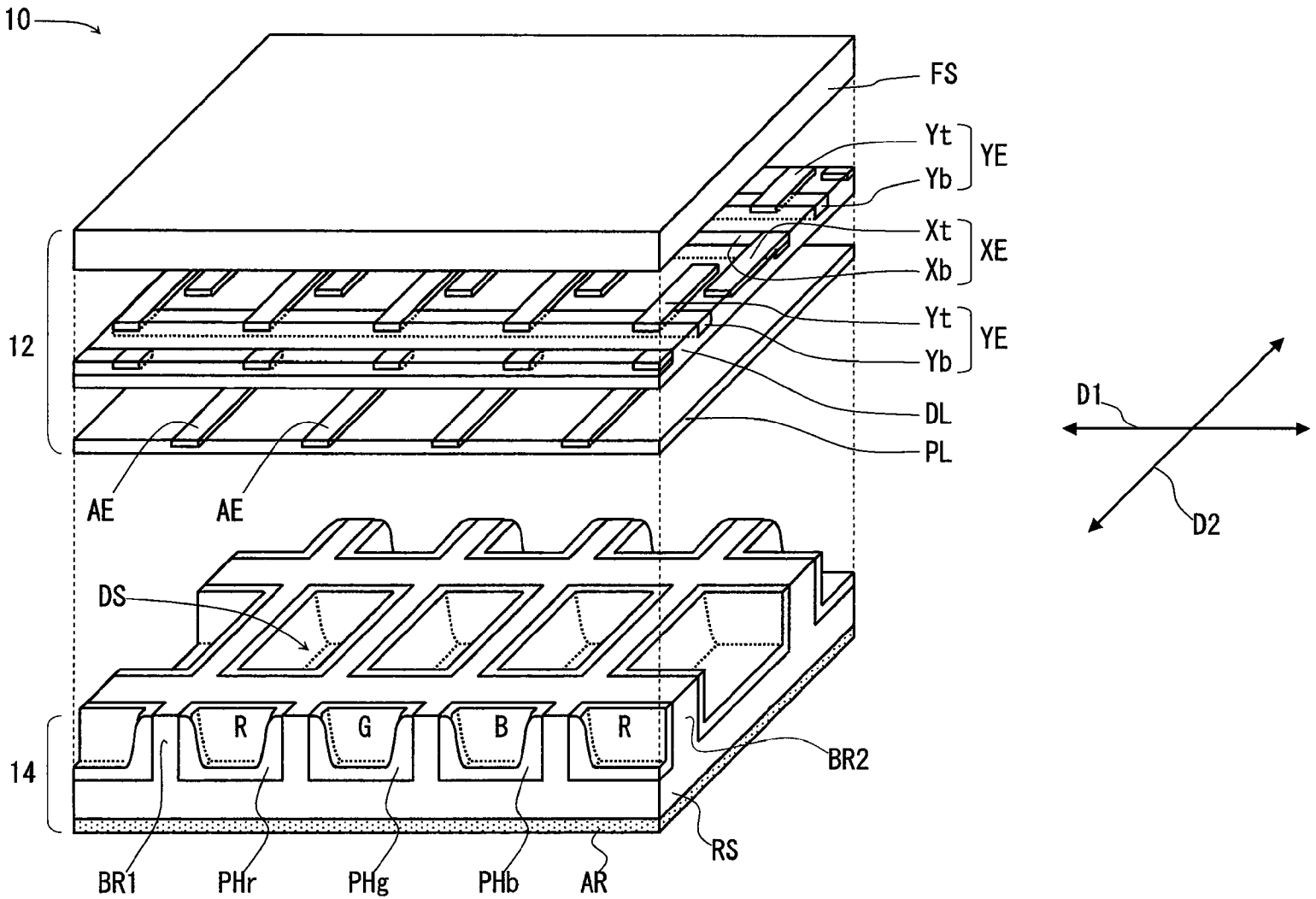
FIG. 1 is a view illustrating a substantial part of a PDP in an embodiment.

FIG. 1 illustrates a substantial part of a plasma display panel (hereinafter, called also as a PDP) in an embodiment. An arrow D1 in the drawing represents a first direction D1, and an arrow D2 represents a second direction D2 orthogonal to the first direction D1 within a surface in parallel with an image display surface. Besides, a half-tone dot meshing portion in the drawing represents a portion which are made black (antireflective film AR). A PDP 10 is made up of a front plate part 12 making up the image display surface and a back plate part 14 facing the front plate part 12. A discharge space DS is formed between the front plate part 12 and the back plate part 14 (in more detail, at a dent part of the back plate part 14).

The front plate part 12 has X bus electrodes Xb and Y bus electrodes Yb formed in parallel along the first direction D1 and formed alternately along the second direction D2 on a glass base FS (first plate) (at a lower side in the drawing). The glass base FS is formed by a material penetrating visible light. Besides, X transparent electrodes Xt extending in the second direction D2 from the X bus electrodes Xb to the Y bus electrodes Yb are coupled to the X bus electrodes Xb. Y transparent electrodes Yt extending in the second direction D2 from the Y bus electrodes Yb to the X bus electrodes Xb are coupled to the Y bus electrodes Yb. In an example in the drawing, the X transparent electrode Xt and the Y transparent electrode Yt face along the second direction D2. Note that the transparent electrodes Xt, Yt may be provided to face along the first direction D1, and may be provided to face along a diagonal direction relative to the first direction D1 (or the second direction D2).

Here, the X bus electrode Xb and the Y bus electrode Yb are opaque electrodes formed by a metallic material and so on, and the X transparent electrode Xt and the Y transparent electrode Yt are transparent electrodes penetrating visible light formed by an ITO film and so on. An X electrode XE (first electrode, sustain electrode) is made up of the X bus electrode Xb and the X transparent electrode Xt, and a Y electrode YE (second electrode, scan electrode) is made up of the Y bus electrode Yb and the Y transparent electrode Yt. Discharge (sustain discharge) is repeatedly generated at an electrode pair made up of the X electrode XE and the Y electrode YE (more specifically, between the X transparent electrode Xt and the Y transparent electrode Yt).

Besides, the transparent electrodes Xt and Yt may be disposed on a whole surface between the bus electrodes Xb and Yb to which they are respectively coupled and the glass base FS. Note that electrodes which are made of the same material (metallic material and so on) as the bus electrodes Xb and Yb, and integrated with the bus electrodes Xb and Yb may be formed instead of the transparent electrodes Xt and Yt.

The electrodes Xb, Xt, Yb, Yt are covered by a dielectric layer DL. For example, the dielectric layer DL is an insulating film such as a silicon dioxide film formed by a CVD method. Plural address electrodes AE extending in an orthogonal direction (second direction D2) of the bus electrodes Xb, Yb are provided on the dielectric layer DL (at a lower side in the drawing). For example, the address electrode AE is formed by the metallic material and so on, and a surface at a side on which outside light is incident is made black. As stated above, the front plate part 12 has the glass base FS in which the plural electrodes XE, YE extending in the first direction D1 and the plural address electrodes AE extending in the second direction D2 are provided. Namely, the PDP according to this embodiment has three electrodes (electrodes XE, YE, AE) at the front plate part 12.

The address electrodes AE and the dielectric layer DL are covered by a protective layer PL. For example, the protective layer PL is formed by an MgO film of which emission characteristic of secondary electrons resulting from collision of a positive ion is high to make the discharge easy to occur. Note that a dielectric layer other than the dielectric layer DL may be provided between the address electrodes AE, the dielectric layer DL and the protective layer PL.

The back plate part 14 has a glass base RS (second plate) facing the glass base FS via the discharge space DS. For example, the glass base RS is formed by a material penetrating visible light. A barrier rib in grid state made up of first barrier ribs BR1 extending in the second direction D2 and second barrier ribs BR2 extending in the first direction D1 is formed on the glass base RS (on a surface of the glass base RS facing the glass base FS). In this embodiment, the barrier ribs BR1, BR2 are the same material as the glass base RS, and integrally formed with the glass base RS.

For example, the barrier ribs BR1, BR2 are integrally formed with the glass base RS by selectively removing a portion of the glass base RS where the discharge space DS of the glass base RS is formed by a sand blast method and so on. Namely, the first ribs BR1 are provided at the glass base FS side of the glass base RS to extend in the second direction D2, and integrally formed with the glass base RS. Besides, the second barrier ribs BR2 are provided at the glass base FS side of the glass base RS to extend in the first direction D1, and integrally formed with the glass base RS and the first ribs BR1.

For example, in this embodiment, the second barrier ribs BR2 are disposed between the bus electrodes Xb, Yb adjacent each other when they are seen from the image display surface side (an upper side of the drawing). Note that the second barrier ribs BR2 may be disposed at a position overlapping with only either of the bus electrodes Xb, Yb adjacent each other, or disposed at a position overlapping with both of the bus electrodes Xb, Yb adjacent each other when they are seen from the image display surface side (the upper side of the drawing). Otherwise, the second barrier ribs BR2 may be respectively disposed at a position overlapping with the bus electrode Xb and a position overlapping with the bus electrode Yb when they are seen from the image display surface side (the upper side of the drawing).

Sidewalls of a cell are made up by the barrier ribs BR1, BR2. Phosphors PHr, PHg, PHb emitting visible lights in red (R), green (G), blue (B) exited by ultraviolet ray are respectively coated at side surfaces of the barrier ribs BR1, BR2 and on the glass base RS at a portion surrounded by the barrier ribs BR1, BR2.

The antireflective film AR is provided on a surface of the glass base RS at an opposite side of a surface facing the glass base FS (the lower side in the drawing). For example, the antireflective film AR is disposed at a position at least overlapping with all over a display area of an image (for example, an area surrounded by the barrier ribs BR1, BR2 disposed at the outermost side) when it is seen from the image display surface side (the upper side of the drawing). Outside light penetrating the barrier ribs BR1, BR2 is absorbed by the antireflective film AR. In this embodiment, it is thereby possible to reduce a reflection amount of the outside light incident on the PDP 10, and to improve the contrast of the image.

Here, the antireflective film AR is formed by, for example, coating a black pigment (dark color pigment) on the surface of the glass base RS at the opposite side of the surface facing the glass base FS after adhering the glass base RS and the glass base FS. Namely, in this embodiment, the antireflective film AR is formed by a nonmetal material, and is made black. As stated above, in this embodiment, the back plate part 14 including the antireflective film AR is made up without using the metallic material, and therefore, it is possible to make a manufacturing process of the back plate part 14 and an assembly process of the PDP (the process adhering the glass base RS and the glass base FS and so on) easy.

One pixel of the PDP 10 is made up of three cells emitting lights in red, green, and blue. Here, one cell (one color pixel) is formed at an area surrounded by, for example, the barrier ribs BR1, BR2. As stated above, the PDP 10 is made up by disposing the cells in matrix state and by alternately arranging plural kinds of cells emitting lights of which colors are different from one another to display the image. A display line is made up of the cells formed along the bus electrodes Xb, Yb, though it is not illustrated in particular.

The PDP 10 is made up by adhering the front plate part 12 and the back plate part 14 so as to bring the protective layer PL into contact with the first barrier ribs BR1, and so on, and by encapsulating discharge gas such as Ne, Xe into the discharge space DS.

Figure 2:
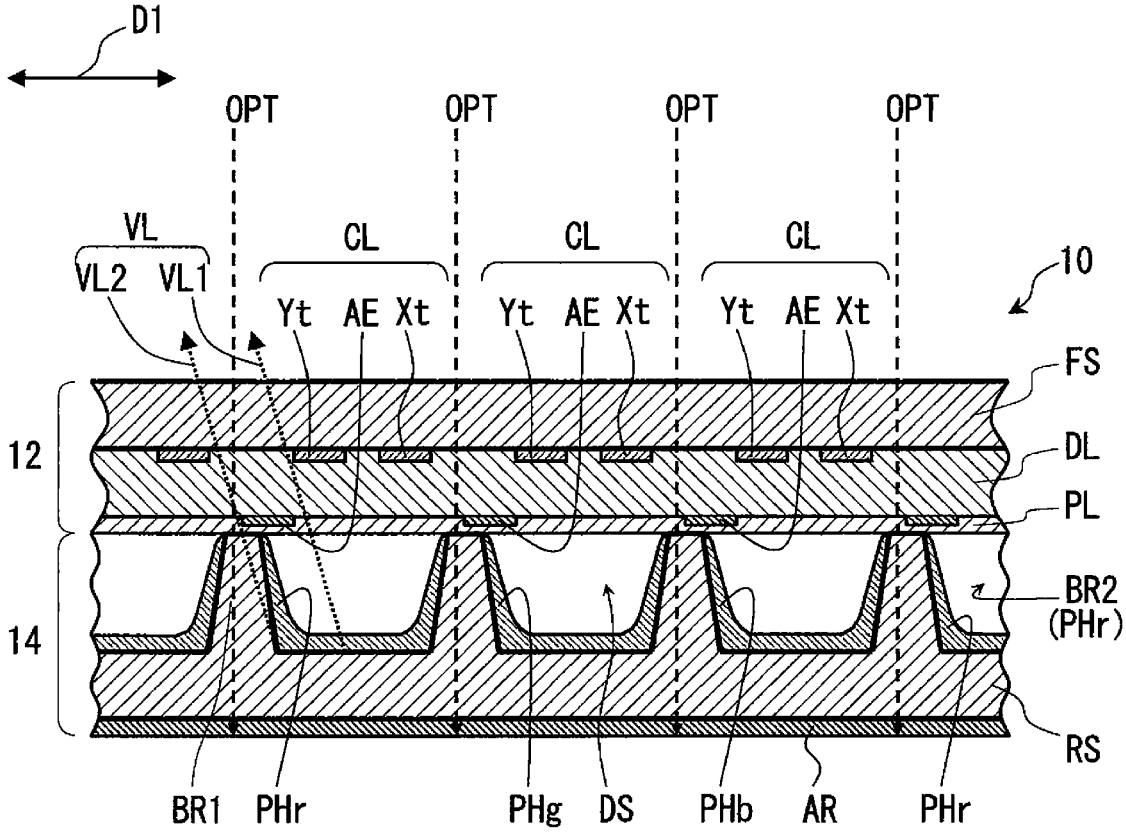
FIG. 2 is a view illustrating a cross section along a first direction of the PDP illustrated in FIG. 1.

FIG. 2 illustrates a cross section along the first direction D1 of the PDP 10 illustrated in FIG. 1. Note that FIG. 2 illustrates the cross section at a position where the X transparent electrode Xt and the Y transparent electrode Yt face each other (the cross section between the bus electrode Xb and the bus electrode Yb paired with each other). A meaning of the arrow D1 in the drawing is the same as the above-stated FIG. 1. Arrows VL (VL1, VL2) illustrated by dotted lines in the drawing represent visible lights emitted from cells CL, and arrows OPT illustrated by dotted lines represent lights (illumination light, outside light, and so on) heading from outside of the PDP 10 to the PDP 10. Hereinafter, the lights heading from outside of the PDP 10 to the PDP 10 are called as an outside light OPT without discriminating the illumination light (light from illumination) from the outside light and so on. The cells CL represent respective cells (cells emitting lights in red, green, and blue) making up the pixels.

At least a part of the address electrode AE positions above the discharge space DS. Namely, at least a part of the address electrode AE are disposed in the cell CL. The transparent electrode Yt is disposed in each cell CL so as to be adjacent to the address electrode AE, and the transparent electrode Xt is disposed in each cell CL so as to be adjacent to the transparent electrode Yt. It is thereby possible to generate an address discharge at a focused cell CL by applying a voltage between the address electrode AE and the transparent electrode Yt. Besides, it is possible to generate the sustain discharge at a cell CL selected by the address discharge by applying a voltage between the transparent electrode Xt and the transparent electrode Yt.

Besides, as stated above, the antireflective film AR is provided at a rear surface side of the glass base RS (the opposite side of the image display surface, the lower side of the drawing) in this embodiment, and therefore, a part of the outside light OPT incident on the PDP 10 (the outside light OPT penetrating the barrier ribs BR1, BR2) is absorbed by the antireflective film AR, to thereby enable to reduce an amount of the outside light OPT penetrating the PDP 10. Namely, in this embodiment, it is possible to reduce the reflection amount of the outside light OPT incident on the PDP 10 because a part of the outside light OPT incident on the PDP 10 is absorbed by the antireflective film AR.

Further, the reflection amount of the outside light OPT incident on the address electrode AE decreases because the address electrode AE is made black. As a result, it is possible to reduce the reflection amount of the outside light OPT incident on the PDP 10, and to improve the contrast of the image in this embodiment. Namely, an image quality can be improved.

Note that the visible light VL2 emitted from the phosphors PHr, PHg, PHb toward the barrier ribs BR1, BR2 side penetrates the barrier ribs BR1, BR2 to be emitted from the PDP 10 together with the visible light VL1 because the barrier ribs BR1, BR2 penetrate the visible light VL. The visible light VL1 is the visible light emitted from, for example, the phosphors PHr, PHg, PHb toward the discharge space DS side. Accordingly, it is possible to make the visible light VL emitted from the phosphors PHr, PHg, PHb effectively contribute to the display of the image in this embodiment. Namely, it is possible to reduce the reflection of the outside light without incurring the deterioration of luminance, and to improve the image quality in this embodiment.

Figure 3:
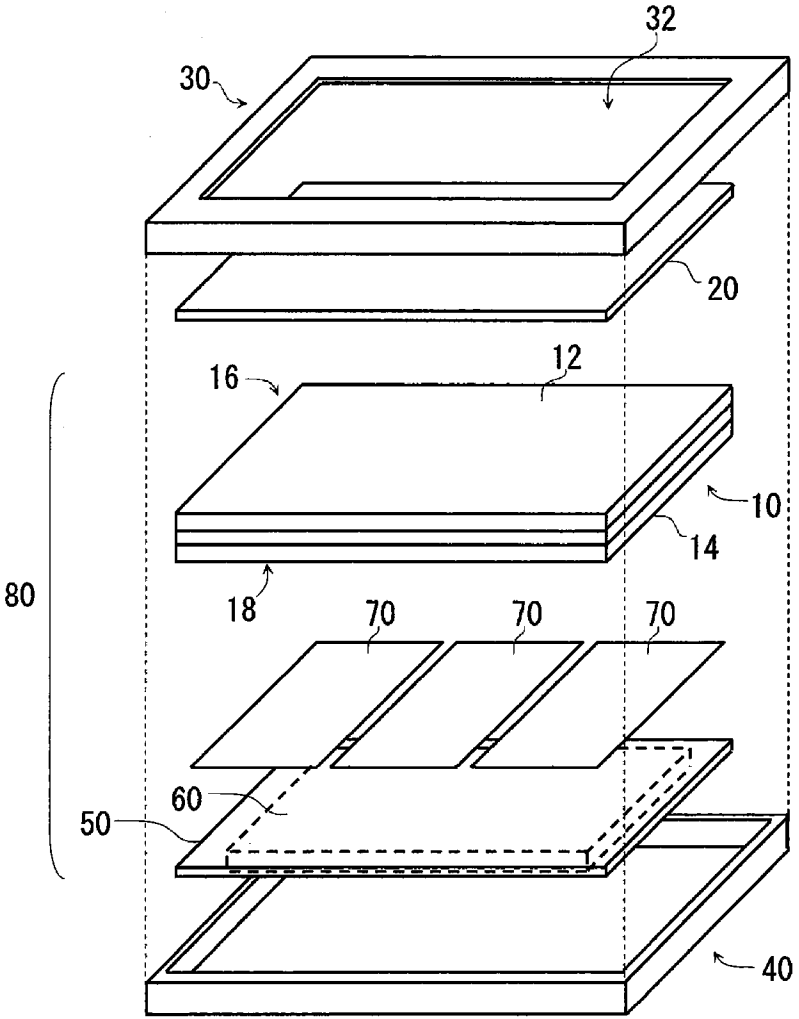
FIG. 3 is a view illustrating an example of a plasma display device made up by using the PDP illustrated in FIG. 1.

FIG. 3 illustrates an example of a plasma display device made up by using the PDP 10 illustrated in FIG. 1. The plasma display device (hereinafter, called also as a PDP device) has the PDP 10, an optical filter 20 provided at an image display surface 16 side (an output side of light) of the PDP 10, a front case 30 disposed at the image display surface 16 side of the PDP 10, a rear case 40 and a base chassis 50 disposed at a back surface 18 side of the PDP 10, a circuit unit 60 attached at the rear case 40 side of the base chassis 50 to drive the PDP 10, and a double-faced adhesive sheet 70 to adhere the PDP 10 to the base chassis 50. The circuit unit 60 is made up of plural components, and therefore, it is represented by a dotted line box in the drawing.

The optical filter 20 is adhered to a protection glass (not-illustrated) attached to an opening part 32 of the front case 30. For example, the optical filter 20 has a function to lower a penetrable rate of the visible light so as to improve the contrast of the image of the PDP device. Note that the optical filter 20 may have a function to shield electromagnetic waves. Besides, the optical filter 20 may be adhered not to the protection glass but to the image display surface 16 side of the PDP 10 directly. Here, for example, a plasma display panel unit (hereinafter, called also as a PDP unit) 80 is made up by including the PDP 10, the base chassis 50, the circuit unit 60, and the double-faced adhesive sheet 70.

In this embodiment, a part of the outside light OPT incident on the PDP 10 is absorbed by the antireflective film AR illustrated in the above-stated FIG. 2, and therefore, it is possible to reduce the amount of the outside light OPT penetrating the PDP 10. Accordingly, it is possible to reduce the amount of the visible light penetrating the PDP 10 and reflected in the PDP device (for example, the base chassis 50) among the visible light incident on the PDP 10 (for example, the outside light OPT illustrated in the above-stated FIG. 2) in the PDP device. Note that the reflected light incident on the PDP is absorbed by the antireflective film AR even when the visible light reflected in the PDP device is incident on the PDP 10 again, and therefore, it is possible to prevent that the reflected light reaches the image display surface (front plate part 12) of the PDP 10.

Accordingly, it is possible to prevent that the visible light other than the visible light emitted from the phosphors PHr, PHg, PHb illustrated in the above-stated FIG. 2 (for example, the visible light which is the reflected outside light OPT incident on the PDP 10) is emitted from the PDP 10, and to improve the contrast of the image displayed by the PDP device in this embodiment. Incidentally, it is possible to increase the penetrable rate of the optical filter 20 when the contrast of the image displayed by the PDP device is maintained to be the same as the conventional level.

In this case, the amount of the visible light absorbed by the optical filter 20 decreases among the visible light emitted from the phosphors PHr, PHg, PHb, and therefore, it is possible to improve the luminance of the image displayed by the PDP device. Namely, the image quality can be improved. Besides, it is possible to manufacture the optical filter 20 easily and in low cost when the contrast of the image displayed by the PDP device is maintained to be the same as the conventional level, because a layer and so on to lower the penetrable rate is not necessary to be provided at the optical filter 20.

As stated above, the antireflective film AR is provided at the rear surface side of the glass base RS (on the surface of the glass base RS at the opposite side of the surface facing the glass base FS) of the PDP 10 in this embodiment. Besides, the barrier ribs BR1, BR2 are integrally formed with the glass base RS with the same material as the glass base RS. Accordingly, it is possible to reduce the reflection amount of the outside light OPT incident on the PDP 10 without incurring the deterioration of the luminance in this embodiment. Namely, it is possible to improve the contrast of the image without incurring the deterioration of the luminance and to improve the image quality in this embodiment.

Figure 4:
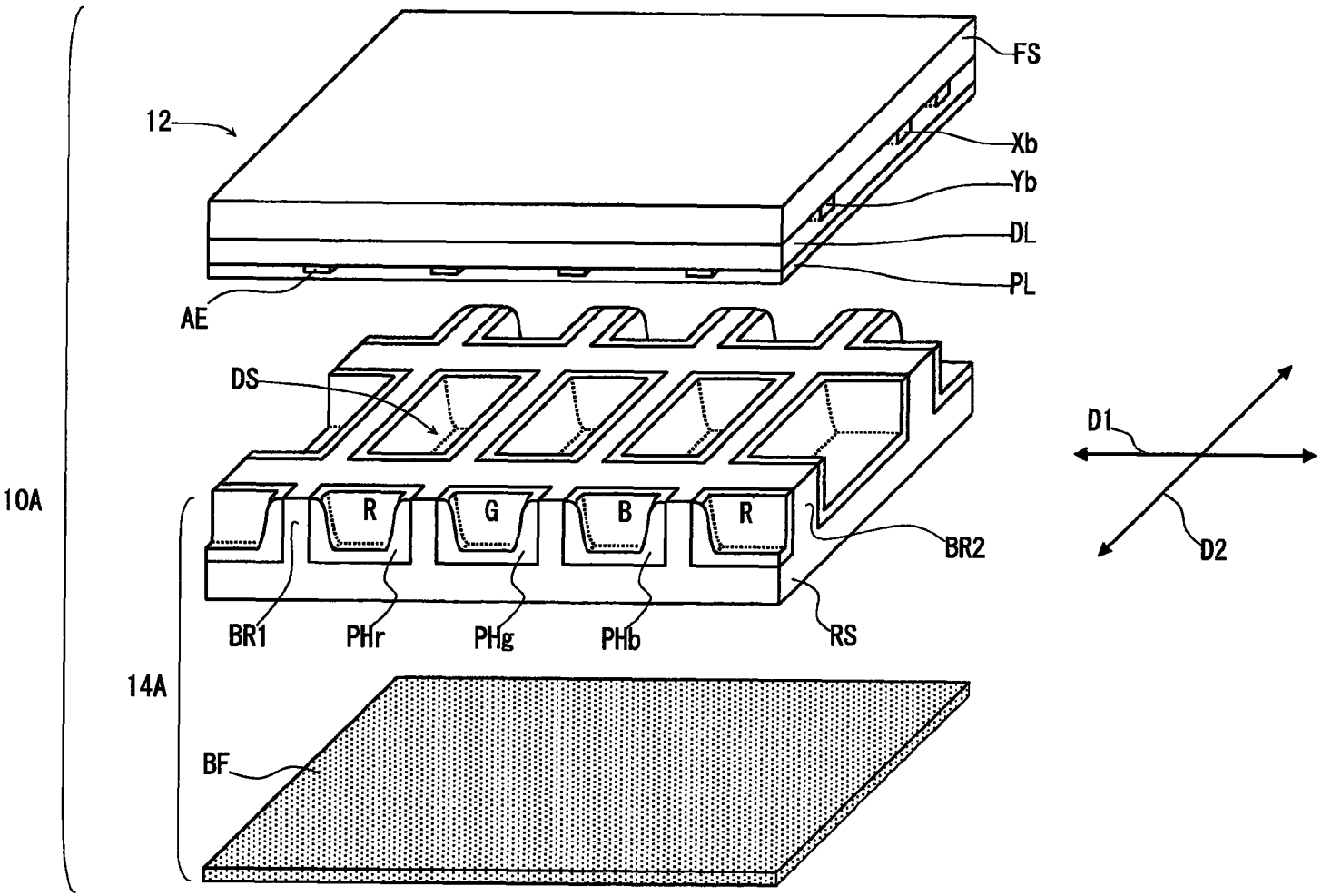
FIG. 4 is a view illustrating a substantial part of a PDP in another embodiment.

FIG. 4 illustrates a substantial part of a PDP 10A in another embodiment. In this embodiment, a black filter BF is provided instead of the antireflective film AR illustrated in the above-stated FIG. 1. The other constitution is the same as FIG. 1 to FIG. 3. The same reference numerals are used to designate the same elements as the elements described in FIG. 1 to FIG. 3, and detailed descriptions are avoided as for these. Besides, a PDP device and a PDP unit using the PDP 10A in this embodiment are the same as FIG. 3 except that the PDP 10A is used instead of the PDP 10 illustrated in FIG. 1. Note that the descriptions of the transparent electrodes Xt, Yt illustrated in FIG. 1 are not given in FIG. 4.

A back plate part 14A has the glass base RS, the barrier ribs BR1, BR2, the phosphors PHr, PHg, PHb, and the black filter BF. The glass base RS, the barrier ribs BR1, BR2, the phosphors PHr, PHg, PHb are the same as the above-stated FIG. 1. Note that the black filter BF is provided on the surface of the glass base RS at the opposite side of the surface facing the glass base FS (a lower side in the drawing) instead of the antireflective film AR illustrated in FIG. 1. For example, the black filter BF is disposed at a position at least overlapping with all over a display area of an image when it is seen from the image display surface side (an upper side of the drawing).

The black filter BF is a filter in black to absorb the outside light, and it is adhered to the rear surface of the glass base RS (the surface at the opposite side of the surface facing the glass base FS). For example, the black filter BF is adhered to the rear surface of the glass base FS by a not-illustrated double-faced adhesive sheet and so on after the glass base RS and the glass base FS are adhered. Namely, the black filter BF functions as an antireflective film absorbing the outside light penetrating the barrier ribs BR1, BR2, and so on. As stated above, the similar effect as the embodiment described in the above-stated FIG. 1 to FIG. 3 can be obtained also in this embodiment.

Figure 5:
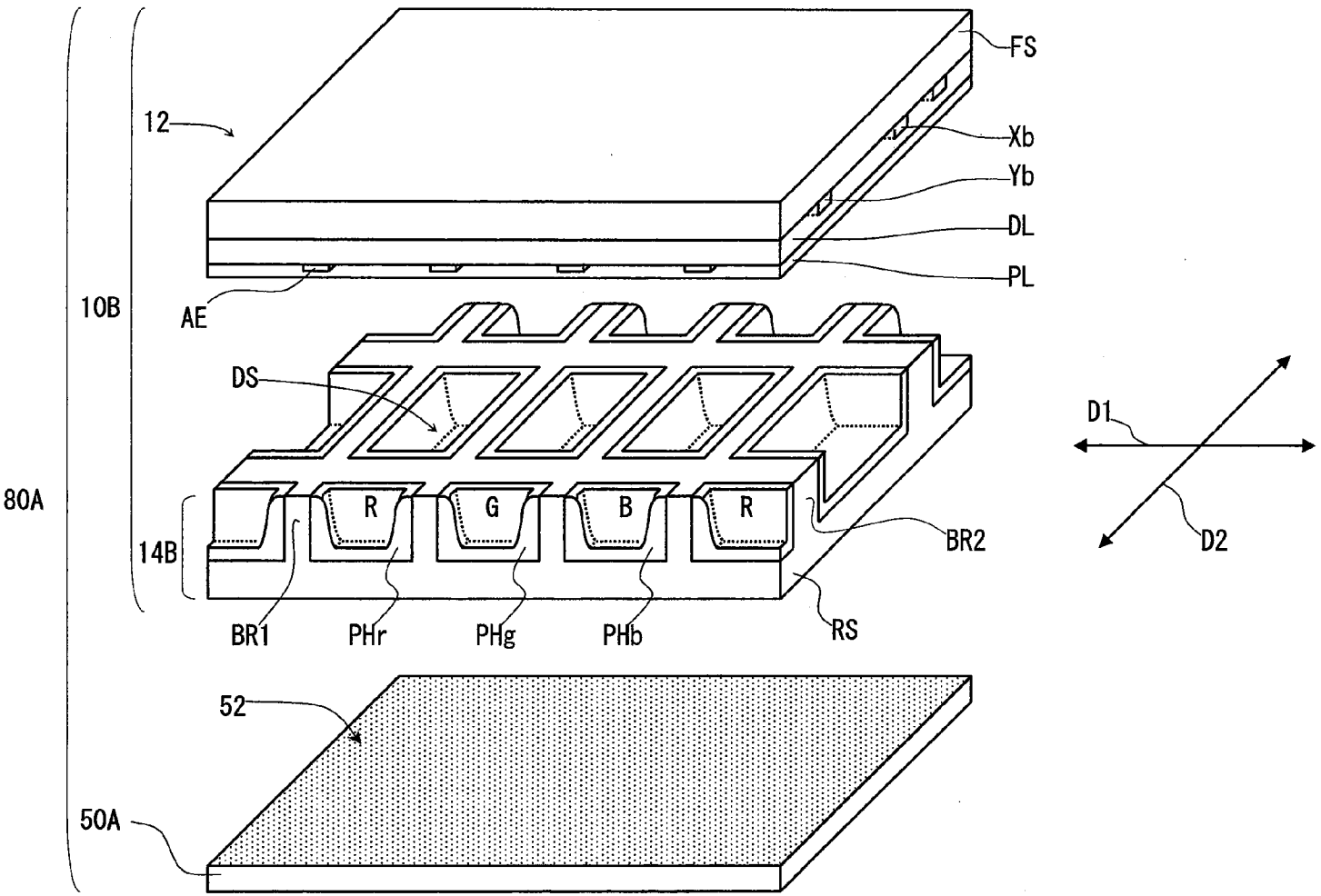
FIG. 5 is a view illustrating a substantial part of a PDP unit in another embodiment.

FIG. 5 illustrates a substantial part of a PDP unit 80A according to another embodiment. A PDP 10B and a base chassis 50A are respectively provided in the PDP unit 80A according to this embodiment instead of the PDP 10 and the base chassis 50 illustrated in the above-stated FIG. 3. The other constitution is the same as FIG. 1 to FIG. 3. The same reference numerals are used to designate the same elements as the elements described in FIG. 1 to FIG. 3, and detailed descriptions are avoided as for these. Note that the description of the transparent electrodes Xt, Yt illustrated in FIG. 1 is not given in FIG. 5. Besides, a half-tone dot meshing portion in the drawing represents a portion which is made black.

The PDP 10B has the front plate part 12 and a back plate part 14B. The front plate part 12 is the same as the above-stated FIG. 1. The back plate part 14B is made up by excluding the antireflective film AR from the back plate part 14 illustrated in FIG. 1. The PDP unit 80A is made up by including the PDP 10B, the base chassis 50A, and the circuit unit 60 and the double-faced adhesive sheet 70 illustrated in a later-described FIG. 5. A surface 52 of the base chassis 50A at the PDP 10B side is made black. The base chassis 50A thereby functions as an antireflective member absorbing the outside light penetrating the barrier ribs BR1, BR2, and so on. Note that all of the base chassis 50A may be made black.

Figure 6:
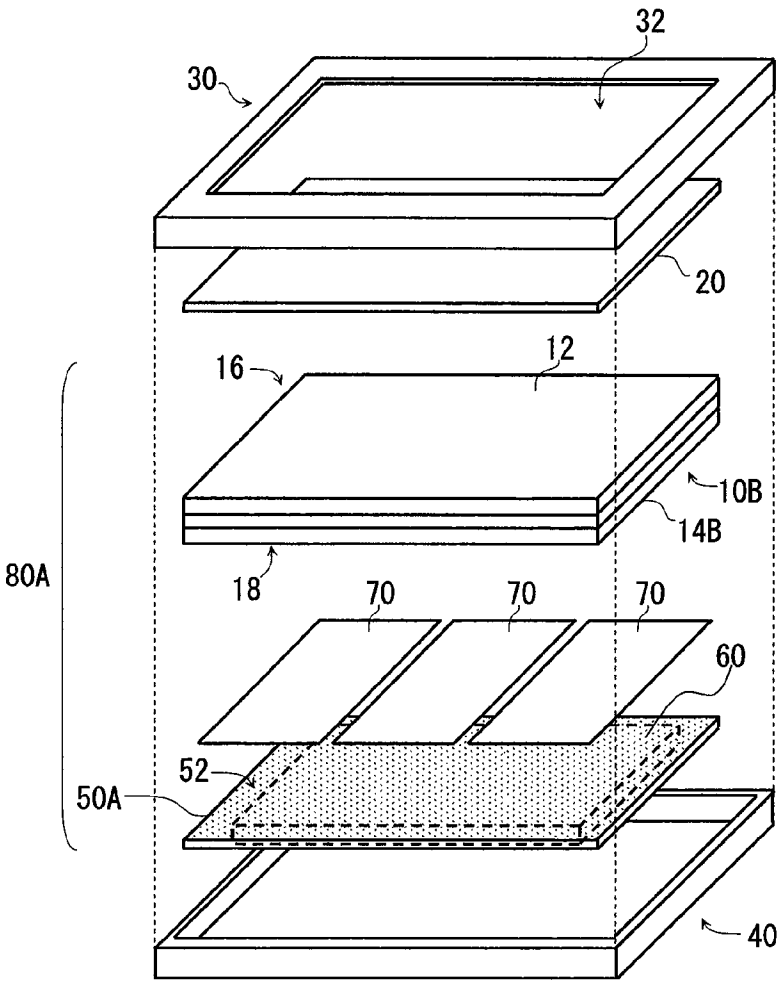
FIG. 6 is a view illustrating an example of a plasma display device made up by using the PDP unit illustrated in FIG. 5.

FIG. 6 illustrates an example of a plasma display device made up by using the PDP unit 80A illustrated in FIG. 5. The PDP device has the PDP unit 80A, the optical filter 20, the front case 30, and the rear case 40. The optical filter 20, the front case 30, and the rear case 40 are the same as the above-stated FIG. 3. The PDP unit 80A has the PDP 10B, the base chassis 50A, the circuit unit 60, and the double-faced adhesive sheet 70 as described in the above-stated FIG. 5. Note that the circuit unit 60 is made up by plural components, and therefore, it is represented by a dotted line box in the drawing. Besides, a half-tone dot meshing portion in the drawing represents a portion which is made black.

In this embodiment, the double-faced adhesive sheet 70 is formed by, for example, a material penetrating the outside light. Otherwise, the double-faced adhesive sheet 70 may be formed by a material absorbing the outside light as illustrated in a later-described FIG. 7. Note that when the double-faced adhesive sheet 70 is formed by a material of which reflection rate of light is high, the double-faced adhesive sheet 70 is disposed at a position not overlapping with an area where the barrier ribs BR1, BR2 illustrated in FIG. 5 are formed (for example, a peripheral part of the PDP 10B) when it is seen from the image display surface 16 side. The outside light penetrating the PDP 10B is thereby absorbed by the base chassis 50A in this embodiment, and therefore, it is possible to reduce the reflection amount of the outside light penetrating the PDP 10B. As stated above, the similar effect as the embodiment described in the above-stated FIG. 1 to FIG. 3 can be obtained also in this embodiment.

Figure 7:
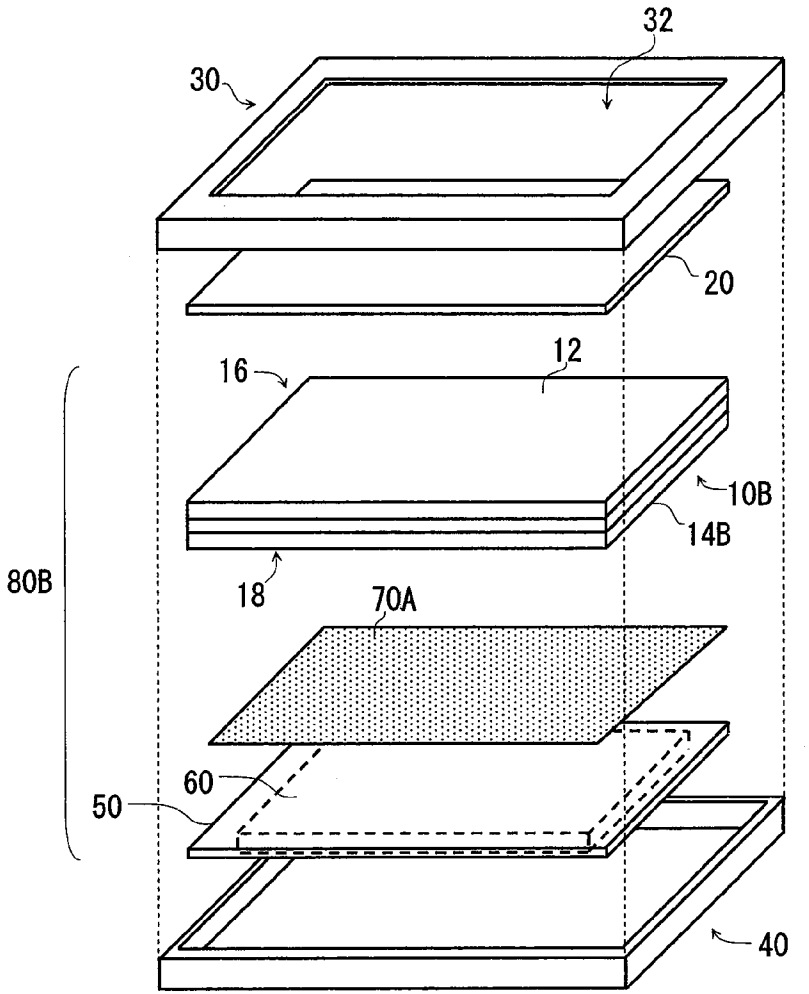
FIG. 7 is a view illustrating an example of a plasma display device made up by using the PDP unit in another embodiment.

FIG. 7 is a view illustrating an example of a PDP device made up by using a PDP unit 80B in another embodiment. The PDP 10B and a double-faced adhesive sheet 70A are respectively provided in the PDP unit 80B according to this embodiment instead of the PDP 10 and the double-faced adhesive sheet 70 illustrated in the above-stated FIG. 3. The other constitution is the same as FIG. 1 to FIG. 3. The same reference numerals are used to designate the same elements as the elements described in FIG. 1 to FIG. 3, and detailed descriptions are avoided as for these. Besides, a half-tone dot meshing portion in the drawing represents a portion which is made black.

The PDP unit 80B has the PDP 10B, the base chassis 50, the circuit unit 60 and a double-faced adhesive sheet 70A. The PDP 10B is the same as the above-stated FIG. 5, and the base chassis 50 and the circuit unit 60 are the same as FIG. 3. A surface of the double-faced adhesive sheet 70A at the PDP 10B side is made black. Besides, the double-faced adhesive sheet 70A is disposed at a position overlapping with the area where the barrier ribs BR1, BR2 illustrated in FIG. 1 are formed (for example, a position overlapping with the display area of the image) when it is seen from the image display surface 16 side. The double-faced adhesive sheet 70A thereby functions as an antireflective member absorbing the outside light penetrating the PDP 10B. Note that all over the double-faced adhesive sheet 70A may be made black. As stated above, the similar effect as the embodiment described in the above-stated FIG. 1 to FIG. 3 can be obtained also in this embodiment.

Incidentally, the example in which one pixel is made up of three cells (red (R), green (G), blue (B)) is described in the above-stated embodiments. The present invention is not limited to the embodiments. For example, one pixel may be made up of four or more cells. Otherwise, one pixel may be made up of cells emitting colors other than red (R), green (G), blue (B), or one pixel may include a cell emitting a color other than red (R), green (G), blue (B).

The example in which the second direction D2 is orthogonal to the first direction D1 is described in the above-stated embodiments. The present invention is not limited to the embodiments. For example, the second direction D2 may intersect with the first direction D1 in approximately orthogonal direction (for example, 90 degrees±5 degrees). The similar effect as the above-stated embodiments can be obtained also in this case.

The example in which the barrier rib in the matrix state made up of the first barrier ribs BR1 and the second barrier ribs BR2 is integrally formed with the glass base RS is described, in the above-stated embodiments. The present invention is not limited to the embodiments. For example, the second barrier ribs BR2 are not formed, and a barrier rib in a stripe state made up by the barrier ribs BR1 may be integrally formed with the glass base RS. In this case, the cell is formed at an area surrounded by, for example, the bus electrodes Xb, Yb paired with each other and a pair of the first barrier ribs BR1 adjacent each other. The similar effect as the above-stated embodiments can be obtained also in this case.

The example in which the antireflective film AR is formed to be black is described in the above-stated embodiments. The present invention is not limited to the embodiments. For example, the antireflective film AR may be formed to be a dark color other than black. Similarly, the black filter BF, the surface 52 of the base chassis 50A at the PDP side and the surface of the double-faced adhesive sheet 70A at the PDP side may be the dark color other than black. The similar effect as the above-stated embodiments can be obtained also in this case.

The example in which the antireflective film AR is formed after the glass base RS and the glass base FS are adhered is described in the above-stated embodiments. The present invention is not limited to the embodiments. For example, the antireflective film AR may be formed by providing a black layer (dark color layer) at the rear surface of the glass base RS (the surface at the opposite side of the surface facing the glass base FS) before the glass base RS and the glass base FS are adhered. The similar effect as the above-stated embodiments can be obtained also in this case.

The example in which the antireflective film AR is formed by the nonmetal material is described in the above-stated embodiments. The present invention is not limited to the embodiments. For example, the antireflective film AR may be formed to be black or the dark color by sputtering a metallic material such as chromium to the rear surface of the glass base RS. In this case, the antireflective film AR is formed by sputtering the metallic material to the rear surface of the glass base RS (the surface at the opposite side of the surface facing the glass base FS) before the glass base RS and the glass base FS are adhered. The similar effect as the above-stated embodiments can be obtained also in this case.

The example in which the antireflective film AR is disposed at the position overlapping with all over the display area of the image when it is seen from the image display surface side is described in the above-stated embodiments. The present invention is not limited to the embodiments. For example, the antireflective film AR illustrated in FIG. 1 may be disposed at a position at least overlapping with the barrier ribs BR1, BR2 when it is seen from the image display surface side. Similarly, the double-faced adhesive sheet 70A illustrated in FIG. 7 may be disposed at a position at least overlapping with the barrier ribs BR1, BR2 when it is seen from the image display surface side. The similar effect as the above-stated embodiments can be obtained also in this case.

Figure 8:
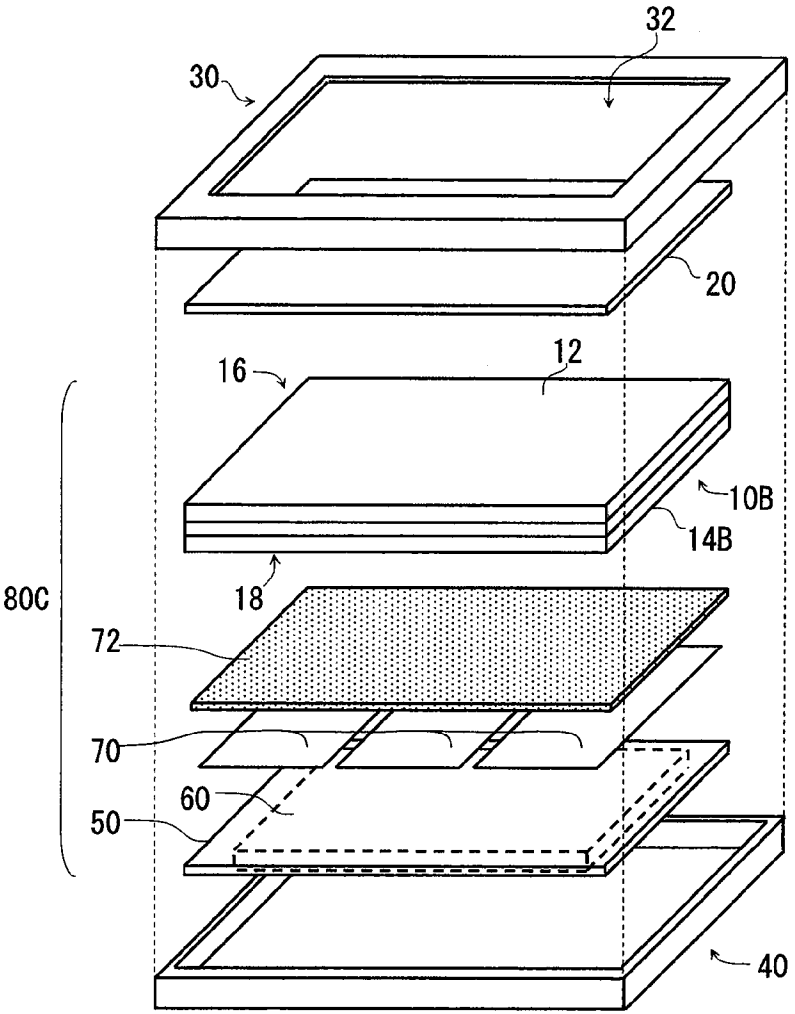
FIG. 8 is a view illustrating a modification example of the plasma display device illustrated in FIG. 6 and FIG. 7.

The example in which the base chassis 50A or the double-faced adhesive sheet 70A is functioned as the antireflective member is described in the above-stated embodiments. The present invention is not limited to the embodiments. For example, an antireflective member 72 may be provided between the PDP 10B and the double-faced adhesive sheet 70 as illustrated in FIG. 8. Namely, the antireflective member 72 is provided at a back surface side of the PDP 10B. The same reference numerals are used to designate the same elements as the elements described in FIG. 6 and FIG. 7, and detailed descriptions are avoided as for these. For example, a configuration of a PDP unit 80C is the same as the PDP unit using the PDP 10A illustrated in FIG. 4 except a definition of the elements making up the PDP (the PDP 10A in FIG. 4 includes the black filter BF, and the PDP 10B in FIG. 8 does not include the black filter BF) when the black filter BF illustrated in FIG. 4 is used as the antireflective member 72. The similar effect as the above-stated embodiments can be obtained also in this case.

The many features and advantages of the embodiment are apparent from the detailed specification and, thus, it is intended by the appended claims to cover all such features and advantages of the embodiment that fall within the true spirit and scope thereof. Further, since numerous modifications and changes will readily occur to those skilled in the art, it is not desired to limit the inventive embodiment to exact construction and operation illustrated and described, and accordingly all suitable modifications and equivalents may be resorted to, falling within the scope thereof.

The invention claimed is:

1. A plasma display panel, comprising:

a first plate and a second plate facing each other by way of a discharge space;

a first bus electrode and a second bus electrode extending in a first direction on the first plate;

a plurality of first barrier ribs provided to extend in the a second direction at the first plate intersecting with the first direction side of the second plate, and integrally formed with the second plate;

a plurality of black address electrodes disposed at respective positions facing the first barrier ribs;

a cell formed in a region surrounded by the first bus electrode, the second bus electrode, and the first barrier ribs;

a first transparent electrode disposed in the cell, coupled to the first bus electrode, and extending from the first bus electrode toward the second bus electrode;

a second transparent electrode disposed in the cell, coupled to the second bus electrode, extending from the second bus electrode toward the first bus electrode, and including an opposed part of the first transparent electrode along the second direction;

an antireflective film formed at a back surface side of the plasma display panel which is on a surface of the second plate at an opposite side of a surface facing the first plate wherein:

the first transparent electrode and the second transparent electrode are disposed alternately along the first direction, and each one of the address electrodes is disposed to lean to one side in the first direction from a center of each one of the first barrier ribs.

2. The plasma display panel according to claim 1, wherein the antireflective film is formed by a nonmetal material.

3. The plasma display panel according to claim 1, further comprising:

a plurality of second barrier ribs provided to extend in the first direction at the first plate side of the second plate, and integrally formed with the second plate and the first barrier ribs.

4. The plasma display panel according to claim 3, wherein the second barrier ribs are disposed at a position overlapping with the first bus electrode and the second bus electrode.

5. The plasma display panel according to claim 1, wherein the second plate and the first barrier ribs are formed by a glass base penetrating visible light.

6. A plasma display panel unit, comprising:

a plasma display panel; and an antireflective member provided at a back surface side of the plasma display panel, wherein the plasma display panel includes:

a first plate providing a first bus electrode and a second bus electrode extending in a first direction, a first transparent electrode coupled to the first bus electrode and extending from the first bus electrode toward the second bus electrode, a second transparent electrode coupled to the second bus electrode and extending from the second bus electrode toward the first bus electrode and including an opposed part of the first transparent electrode along a second direction intersecting with the first direction, a plurality of black address electrodes extending in the second direction, a second plate disposed to face the first plate by way of a discharge space, and a plurality of first barrier ribs provided to extend in the second direction at the first plate side of the second plate, and integrally formed with the second plate, wherein:

the antireflective member is disposed on a surface of the second plate at an opposite side of the first plate, the first transparent electrode and the second transparent electrode are disposed alternately along the first direction, and each one of the address electrodes is disposed at a position facing each one of the first barrier ribs and to lean to one side in the first direction from a center of each one of the first barrier ribs.

7. The plasma display panel unit according to claim 6, further comprising:

a base chassis provided at the back surface side of the plasma display panel and a surface of the base chassis at least overlaps with all over a display area of an image at the plasma display panel side is made a dark color, wherein the antireflective member is the base chassis.

8. The plasma display panel unit according to claim 6, further comprising:

a base chassis provided at the back surface side of the plasma display panel; and a double-faced adhesive sheet disposed between the plasma display panel and the base chassis, and a surface of the double-faced adhesive sheet at the plasma display panel side is made a dark color, wherein the antireflective member is the double-faced adhesive sheet.

9. The plasma display panel unit according to claim 6, further comprising:

a plurality of second barrier ribs provided to extend in the first direction at the first plate side of the second plate, and integrally formed with the second plate and the first barrier ribs, wherein the second barrier ribs are disposed at a position overlapping with the first bus electrode and the second bus electrode.

10. The plasma display panel unit according to claim 9, wherein the second plate, the first barrier ribs, and the second barrier ribs are formed by a glass penetrating visible light.

11. A method of manufacturing a plasma display panel including a first plate and a second plate facing each other by way of a discharge space, in which a first bus electrode and a second bus electrode extend in a first direction, a first transparent electrode coupled to the first bus electrode and extending from the first bus electrode toward the second bus electrode, a second transparent electrode coupled to the second bus electrode and extending from the second bus electrode toward the first bus electrode and including an opposed part of the first transparent electrode along a second direction intersecting with the first direction, and a plurality of black address electrodes extending in a second direction provided at the first plate, the manufacturing method comprising steps of:

forming a plurality of barrier ribs extending in the second direction at the first plate side of the second plate by selectively removing the second plate;

providing an antireflective film on a surface of the second plate at an opposite side of a surface facing the first plate after adhering the first plate and the second plate;

disposing the first transparent electrode and the second transparent electrode alternately along the first direction; and disposing each of the address electrodes at a position facing each one of the first barrier ribs and to lean to one side in the first direction from a center of each one of the first barrier ribs.

12. The manufacturing method of the plasma display panel according to claim 11, further comprising:

forming the antireflective film by coating a dark color pigment at the surface of the second plate at the opposite side of the surface facing the first plate.

* * * * *

UNITED STATES PATENT AND TRADEMARK OFFICE

CERTIFICATE OF CORRECTION

PATENT NO. : 8,179,042 B2
APPLICATION NO. : 12/863749
DATED : May 15, 2012
INVENTOR(S) : Hideaki Yanagita It is certified that error appears in the above-identified patent and that said Letters Patent is hereby corrected as shown below:

Title Page, item (73) the Assignee reads "Hitachi Plasma Display Limited, Miyazaki (JP)"

but should read -- Hitachi, Ltd., Tokyo (JP) --

Signed and Sealed this
Thirteenth Day of November, 2012

David J. Kappos

David J. Kappos
*Director of the United States Patent and Trademark Office*